United States Patent [19]

Vandermeide

[11] Patent Number: 4,827,892

[45] Date of Patent: May 9, 1989

[54] TOY GUN

[76] Inventor: Benjamin Vandermeide, 3904 Hallmark Dr., Salt Lake City, Utah 84119

[21] Appl. No.: 200,238

[22] Filed: May 31, 1988

[51] Int. Cl.[4] ..... F41B 7/02; F41F 7/00

[52] U.S. Cl. ..... 124/19; 124/18; 124/35 R

[58] Field of Search ..... 124/18, 19, 35 R, 41 R

[56] References Cited

U.S. PATENT DOCUMENTS

| | | | |
|---|---|---|---|
| 1,059,736 | 4/1913 | Kilduff | 124/18 |
| 1,461,119 | 7/1923 | Harris | 124/19 |
| 1,909,927 | 5/1933 | Beauchamp et al. | 124/19 |
| 2,021,776 | 11/1935 | Hagen | 124/19 |
| 2,065,580 | 12/1936 | Grawunder | 124/19 |
| 3,437,084 | 4/1969 | Hyter | 124/19 |
| 3,536,055 | 10/1970 | Endo | 124/18 |
| 4,379,445 | 4/1983 | Lobiondo | 124/19 |

FOREIGN PATENT DOCUMENTS

| | | | |
|---|---|---|---|
| 430799 | 6/1935 | United Kingdom | 124/19 |
| 458660 | 12/1936 | United Kingdom | 124/19 |

*Primary Examiner*—Randolph A. Reese
*Assistant Examiner*—John Ricci
*Attorney, Agent, or Firm*—B. Deon Criddle

[57] ABSTRACT

A multiple firing elastic shooter toy including a handle, a rod which may take the form of a barrel and having a notched end to receive lengths of elastic members and a receiver section interconnecting the handle and the rod. The receiver section is of generally U-shaped cross-section and has a web at one side of the shooter and top and bottom legs. Spaced apart slots are formed in the web and partially into the legs of the receiver to accept other lengths of the elastic members. A snubber post projects from the shooter toy at the side opposite the web and forwardly of the slots in the direction of the rod and serves as a safety against inadvertant release of stretched elastic members.

7 Claims, 1 Drawing Sheet

TOY GUN

BRIEF DESCRIPTION OF THE INVENTION

1. Field of the Invention

This invention relates to elastic shooter toys and more particularly to simulated guns that "fire" elastic members. It is more particularly related to such simulated gun toys that will individually and sequentially release a plurality of stretched elastic members.

2. Prior Art

Rubber band firing pistols and rifles have long been known and used. Many times, such pistols and rifles have been homemade. Frequently a barrel and handle or stock are formed and means, such as a clothspin, are used to hold a stretched rubber band or elastic member and to release the stretched member when desired.

Various types of toy guns have been proposed for the individual and sequential firing of a plurality of rubber bands or other elastic means. U.S. Pat. No. 1,461,119, shows a multiple elastic firing toy gun that uses an individual trigger assembly to release each of the plurality of elastic elements. U.S. Pat. No. 1,909,927, discloses a repeating rubber band rifle wherein a plurality of stretched elastic members are sequentially released by a slide mechanism that individually pushes the elastic members from upstanding teeth.

U.S. Pat. No. 2,021,776, discloses a toy gun with a tape and a take-up wheel for the tape and wherein as the tape is rolled onto the wheel it sequentially lifts stretched elastic members from projecting stops and U.S. Pat. No. 2,065,580, discloses a toy gun with a cable having one end wound on a drum and a firing pen at the other end. Winding of the cable onto the drum will pull the pin to sequentially release stretched elastic members.

All of the toy guns, i.e., elastic shooters, with which I am familiar have required multiple parts and movable components to hold and/or release rubber bands or other elastic members that have been stretched taut. Consequently, there has remained a need for an elastic shooter that can be constructed as a one-piece unit and that does not require any moving parts to hold or release stretched elastic members.

3. Objects of the Invention

Principal objects of the present invention are to provide a multiple firing elastic shooter that does not have any moving parts and that provides for accurate discharge of stretched rubber bands or other elastics.

Other objects are to provide a multiple firing elastic shooter that can readily be formed into either a pistol or a rifle configuration and to provide such a shooter that can be constructed are formed of various kinds of materials and preferably of a one-piece configuration.

4. Features of the Invention

Principal features of the invention include its one-piece, easily formed construction resulting in a rod, which may take the form of a barrel; a handle, which may take the form of a rifle stock; and a receiver section interconnecting the rod and the handle.

The receiver is of generally U-shaped configuration and has a web and a pair of legs all aligned in the same plane as the rod and handle. The web of the receiver forms part of one side of the shooter, and has spaced apart slots therealong that also extend into the legs which form top and bottom portions of the receiver. The space between the legs of the receiver is open to permit insertion of a user's finger to push stretched elastic from the receiver.

Another features of the invention is a snubber post projecting from the side of the shooter opposite the web of the receiver and forwardly of the slots in the receiver such that a rubber band or elastic member stretched and ready to be fired can be passed over the snubber post which will then prevent inadvertant release of the elastic member or rubber bands.

Additional objects and features of the invention will become apparent to those skilled in the art to which the invention pertains from the following detailed description and claims.

THE DRAWINGS

In the drawings:

FIG. 1 is a perspective view of the shooter of the invention held in the hand of a user, shown in phantom, and with an elastic member stretched thereon;

FIG. 2, a side elevation view, without the elastic member;

FIG. 3, a top plan view; and

FIG. 4, a side elevation view showing an alternative safety device for the gun.

DETAILED DESCRIPTION

Figure 1:
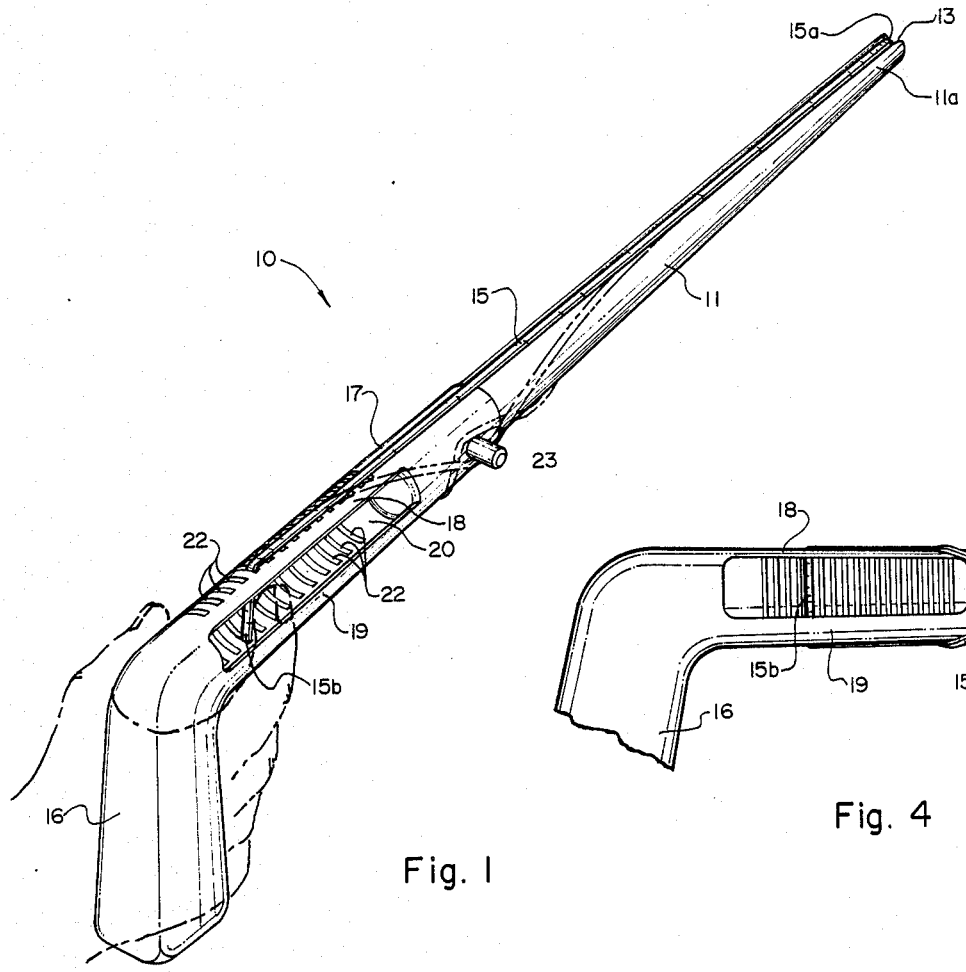

Referring now to the drawings:

In the illustrated preferred embodiment, the toy gun or shooter of the invention is shown generally at 10.

Shooter 10 is preferably made as one-piece, and may be formed of plastic, metal or other suitable materials. Shooter 10 comprises a rod 11, which may be solid, as shown, or tubular, to be more in the form of a gun barrel if desired. In the embodiment shown, rod 11 is flared from its free end 11*a* to receiver portion, shown generally at 12. It will be apparent that the rod can be straight as well as flared and that any selected shape is merely a matter of design choice. A notch 13 in the free end of rod 11 receives a portion 15*a* of an elastic band member 15 and can receive as many other such portions of elastic members as may be accommodated by the receiver portion 12, as well as further described.

The receiver portion 12 interconnects the rod 11 and a handle 16. The handle 16 is here shown as having the same general shape as a pistol grip, but may also take the shape of a rifle stock, in which case the rod 11 may be extended.

The receiver portion 12 is of generally U-shaped cross-sectional configuration, with a web portion 17 that provides a continuation of the side of shooter 10 and an upper leg 18 and a lower leg 19. A space 20 formed between the web portion 17 and legs 18 and 19 is made sufficiently large to permit insertion of a user's index finger tip therein.

When used to discharge a single elastic member such as that shown at 15, a portion 15*a* of the elastic member is positioned in notch 13. The elastic member 15 is then stretched until a portion 15*b* thereof fits into one of the spaced apart, parallel slots 22 formed in the web 17 and stretches across the space 20 formed between legs 18 and 19. The slots 22 may be closely adjacent one another to permit firing of a large number of bands or may be more distantly spaced.

In any event, whether a few or a large number of slots are provided the length of the receiver is only that which will allow a user's finger to confortably release the bands and little difference in velocity is realized from the stretched bands as they are released.

A user, grasping the handle 16 merely pushes on the elastic member 15 with a finger inserted into space 20 to push the portion 15*b* of the elastic member from its slot 22. The slots 22 extend through the web 17 and partially into the legs 18 and 19 to be stretched across the receiver portion 12 and to be easily pushed out of the notch by the user. Once released, the stretched elastic member will be projected from the shooter 10, as well known. The elastic band is released from the side of the receiver and it will be apparent that either a "right hand" or a "left hand" version can be produced by proper orientation of the receiver to allow pushing of the elastic members with either a "right hand" finger or with a "left hand" finger.

A snubber post 23 may extend from the shooter at the side opposite the slots 22. The snubber post serves as a safety device to prevent inadvertant release of the elastic member 15 when the elastic member is pulled over the post. With both long lengths of the elastic member over the snubber post, as shown in dotted lines in FIG. 1, the elastic member is not easily pushed from its slot 22. If released from the slot 22 the released portion will merely slide along the receiver and rod until stopping adjacent the snubber post.

Figure 4:
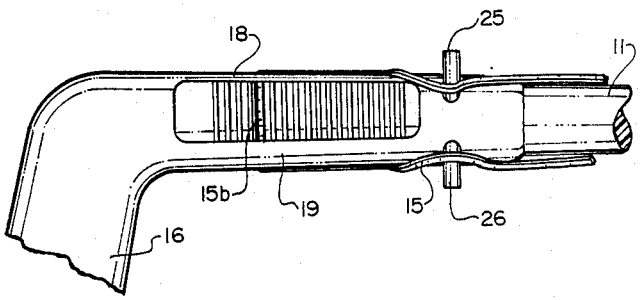
Figure 2:
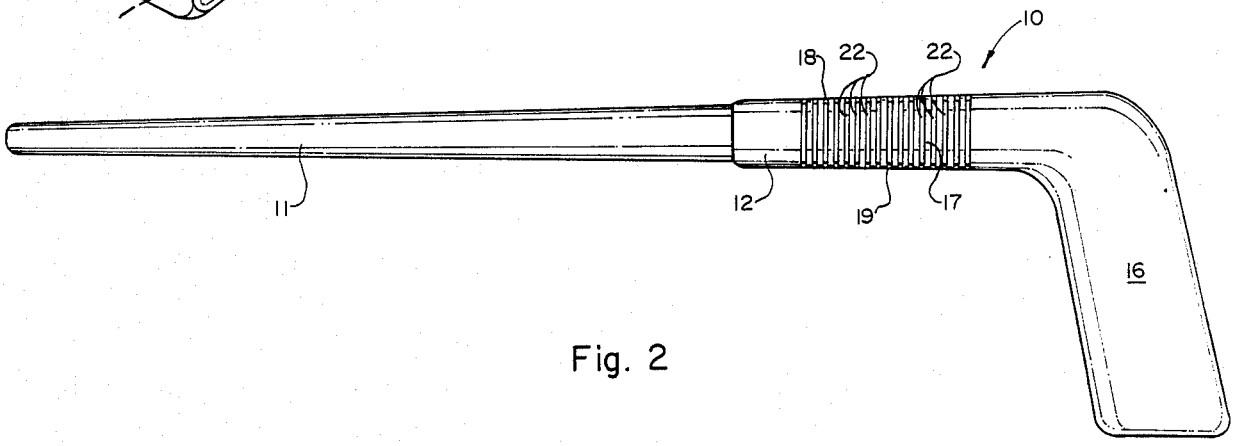
Figure 3:
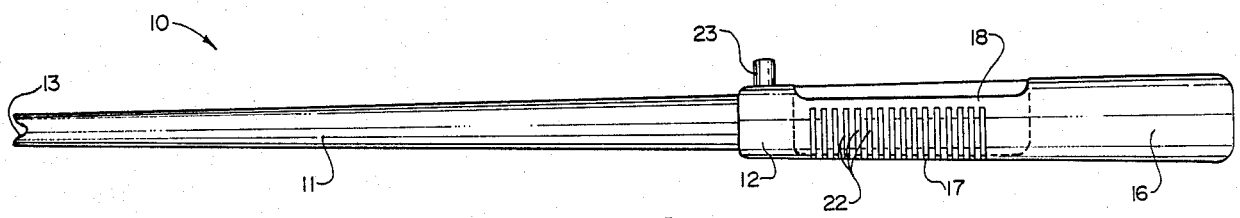

An alternative safety device for the shooter 10 is shown in FIG. 4. In this embodiment the outwardly projecting snubber post 23 is replaced by upwardly and downwardly extending pegs 25 and 26, respectively. The pegs 25 and 26 extend from the side of the receiver or rod opposite the web portion 17. In use, for safety purposes, the long lengths of elastic member 15 are each positioned over a leg 25 or 26. Thereafter, if the elastic band is released from its slot 22, the released portion of the band will only slide along the receiver and rod until the legs 25 and 26 are reached. The elastic band will not release from the rod 11.

The number of elastic band members 15 positioned or loaded on shooter 10 corresponds to the number of slots 22 that are provided. The elastic band members are each positioned to have a portion 15*a* in notch 13 and with each succeeding elastic band member overlying the previously positioned band member in the notch 13. The first positioned elastic band is stretched to be secured in either a slot 22 closest to notch 13 or a slot 22 most remote from the notch 13. Thereafter each succeeding elastic is stretched to be positioned in a succeeding remote or closer slot so that a user can merely push the elastic band members from the adjacent slots in a progressive manner as the user's finger is moved towards or away from the rod 11.

It will be apparent that the shooter 10 may take the form of any type of pistol or rifle and that features such as sights on the receiver and rod can be readily provided since such features will not adversely affect release and shooting of the elastic bands.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A toy gun comprising a handle;

a rod simulating a barrel and having a notch in one end thereof; and a receiver interconnecting the handle and the rod, said receiver being of generally U-shaped configuration and having a web at one side and spaced apart top and bottom legs extending from said web, and at least one slot formed through the web and into the legs, whereby an elastic band member will stretch between the notch and the slot.

2. A toy gun as in claim 1, wherein the receiver has a plurality of parallel slots formed through the web and into the legs.

3. A toy gun as in claim 2, wherein the rod, receiver and handle are formed as a single piece of material.

4. A toy gun as in claim 1, further including safety means to prevent undesired firing of elastic band members from the rod.

5. A toy gun comprising a handle;

a rod simulating a barrel and having a notch in one end thereof;

a receiver interconnecting the handle and the rod, said receiver being of generally U-shaped configuration and having a web at one side and spaced apart top and bottom legs extending from said web, and at least one slot formed through the web and into the legs, whereby an elastic band member will stretch between the notch and the slot; and safety means to prevent undesired firing of elastic band members from the rod, said safety means comprising at least one member projecting from the gun forward of the receiver to have at least one long stretched length of an elastic band pulled thereover.

6. A toy gun as in claim 5, wherein the safety means comprises at least one post projecting from the side of the toy gun opposite the web.

7. A toy gun as in claim 5, wherein the safety means comprises a plurality of posts extending upwardly and downwardly from the side of the gun opposite the web.

* * * * *